US005140115A

United States Patent [19]

Morris

[11] Patent Number: 5,140,115

[45] Date of Patent: Aug. 18, 1992

[54] CIRCUIT BREAKER CONTACTS CONDITION INDICATOR

[75] Inventor: Robert A. Morris, Burlington, Conn.

[73] Assignee: General Electric Company, New York, N.Y.

[21] Appl. No.: 659,655

[22] Filed: Feb. 25, 1991

[51] Int. Cl.[5] ..... H01H 9/00

[52] U.S. Cl. ..... 200/308; 200/312; 335/17; 340/638

[58] Field of Search ..... 200/308, 309, 317, 312, 200/400; 335/17; 340/638, 639

[56] References Cited

U.S. PATENT DOCUMENTS

| | | | |
|---|---|---|---|
| 2,685,011 | 7/1954 | Boller et al. | 200/308 X |
| 3,377,451 | 4/1968 | Kreuter | 200/308 |
| 4,301,342 | 11/1981 | Castonguay et al. | 200/308 X |
| 4,301,433 | 11/1981 | Castonguay et al. | 335/17 X |
| 4,352,967 | 10/1982 | Buchtel | 200/308 X |
| 4,439,653 | 3/1984 | Umino et al. | 200/308 X |
| 4,644,122 | 2/1987 | Farley et al. | 200/308 X |
| 4,728,914 | 3/1988 | Morris et al. | 335/6 |
| 4,754,247 | 6/1988 | Raymont et al. | 335/202 |
| 4,782,583 | 11/1988 | Castonguay et al. | 29/622 |
| 4,796,154 | 1/1989 | Morris et al. | 200/309 X |
| 4,827,231 | 5/1989 | Cheski et al. | 335/17 |
| 4,831,221 | 5/1989 | Yu et al. | 200/553 |
| 4,864,263 | 9/1989 | Castonguay et al. | 335/167 |
| 4,912,439 | 3/1990 | Nagy et al. | 335/132 |

*Primary Examiner*—Henry J. Recla
*Assistant Examiner*—Glenn T. Barrett
*Attorney, Agent, or Firm*—Richard A. Menelly; Fred Jacob

[57] ABSTRACT

The open and closed conditions of the contacts within industrial-rated circuit breakers is externally ascertained by means of an auxiliary switch-contact position verifier accessory. A viewing aperture in the circuit breaker accessory cover provides visual access to a color-coded shutter that forms part of the auxiliary switch accessory and operates off the circuit breaker crossbar assembly. In the event that the circuit breaker contacts remain closed when the circuit breaker operating handle is moved to the OFF position, the colored indicia verifies the actual condition of the circuit breaker contacts.

5 Claims, 4 Drawing Sheets

CIRCUIT BREAKER CONTACTS CONDITION INDICATOR

BACKGROUND OF THE INVENTION

The position of the circuit breaker operating handle in most industrial-rated circuit breaker applications is indicative of the ON or OFF condition of the circuit breaker contacts. When the circuit breaker handle is translated to the OFF position, the circuit breaker contacts in some instances could remain in their closed condition and hence the position of the operating handle, per se, is not a completely reliable indication of the actual condition of the circuit breaker contact.

U.S. Pat. No. 4,827,231 describes the provision of a viewing window in the circuit breaker cover for visual access to the circuit breaker contacts contained therein. This allows an operator to view the actual condition of the circuit breaker contacts independent from the location of the circuit breaker operating handle.

U.S. Pat. Nos. 4,831,221 and 4,912,439 describe auxiliary switch accessories used within industrial-rated molded case circuit breakers. The auxiliary switch accessories interact with the circuit breaker operating mechanism to provide remote indication of the condition of the circuit breaker contacts. The circuit breaker operating mechanism described within U.S. Pat. No. 4,864,263 includes a crossbar unit that carries the movable contact arm and provides an accurate indication as to the actual condition of the contacts. Although the operating handle may translate to its OFF position with the contacts remaining in their closed condition, the operating mechanism crossbar unit is not able to move unless and until the contacts are free to transfer from their closed to their open conditions.

The auxiliary switch accessory unit described within the aforementioned U.S. Patents operates directly off the circuit breaker operating mechanism crossbar unit to provide an accurate indication of the condition of the contacts.

One purpose of the invention is to provide a combined auxiliary switch-contact indication accessory for visual indication of the true condition of the circuit breaker contacts along with remote indication thereof.

SUMMARY OF THE INVENTION

A combined auxiliary switch-contacts indication accessory is installed within the cover of an industrial rated circuit breaker to provide visual indication of the open and closed conditions of the circuit breaker contacts by means of a visual access window formed in the circuit breaker cover. Remote indication is provided by means of wire conductors connecting with the auxiliary switch unit. The combined auxiliary switch-contact indication accessory includes a shutter that carries the indicia of the actual condition of the contacts through logic supplied by the circuit breaker operating mechanism crossbar unit.

DESCRIPTION OF THE PREFERRED EMBODIMENT

Figure 1:
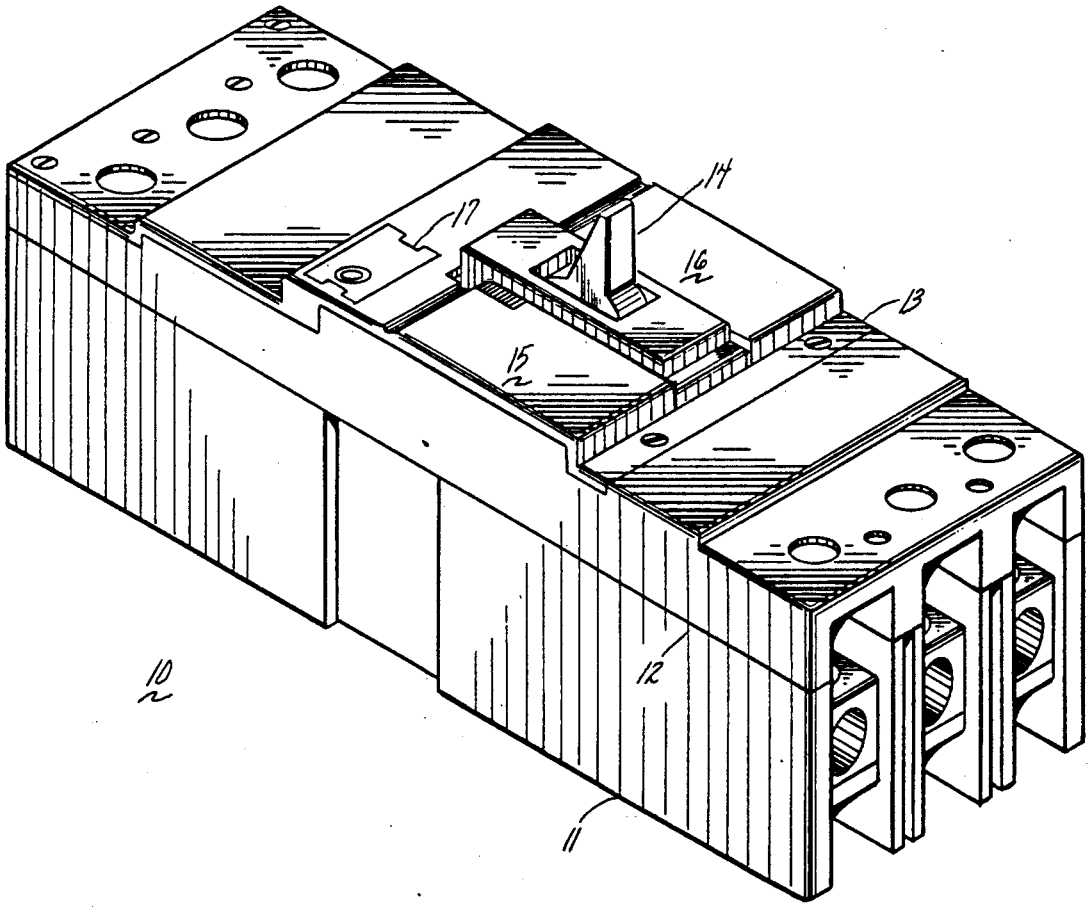
FIG. 1 PRIOR ART
FIG. 1 is a top perspective view of a molded case circuit breaker employing the combined auxiliary switch-contacts condition indicator in accordance with the invention.

An industrial-rated circuit breaker 10 is shown in FIG. 1 and basically consists of a molded plastic case 11 to which a plastic circuit breaker cover 12 and accessory cover 13 are fixedly attached. An operating handle 14 extends through the cover for turning the circuit breaker contacts between their OPEN and CLOSED conditions. Circuit breaker accessories are positioned within the circuit breaker cover and are accessible through the accessory doors 15, 16. A rating plug 17 is used to set the current rating of the circuit breaker, such as described in U.S. Pat. No. 4,754,247.

Figure 2:
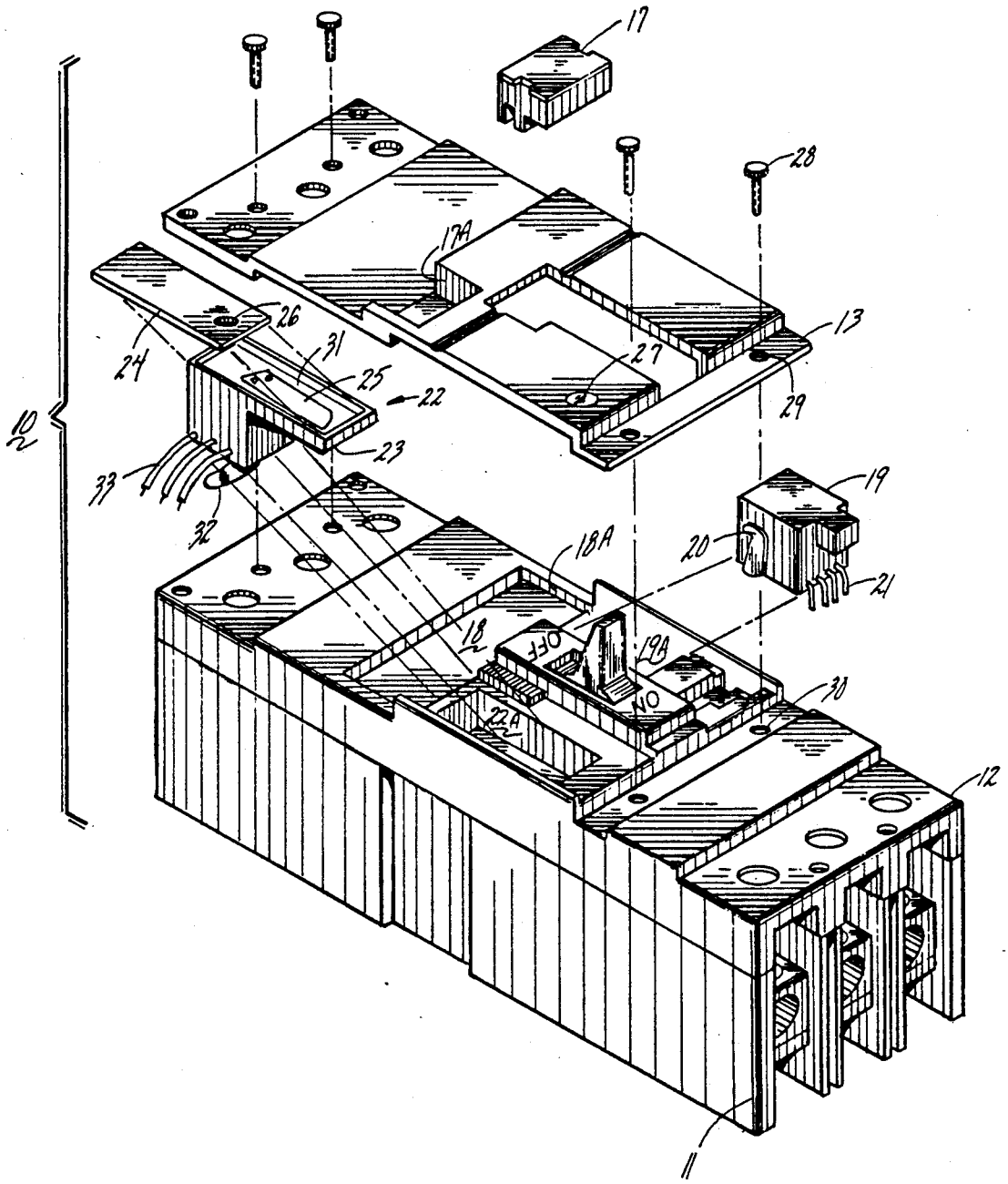
FIG. 2 is a top perspective view of the circuit breaker of FIG. 1 prior to assembly.

The circuit breaker is assembled in the manner best seen by referring now to FIG. 2 where the circuit breaker 10 is shown prior to positioning the rating plug 17 within the rating plug recess 17A formed in the accessory cover 13 and with the circuit breaker cover 12 already attached to the circuit breaker case 11. An actuator-accessory unit 19 is positioned within the actuator-accessory recess 19A formed in the cover and includes a latch 20 that interacts with the circuit breaker operating mechanism (not shown) in the manner described in the aforementioned U.S. Pat. No. 4,864,263. A plurality of wire conductors 21 allow the actuator-accessory unit to be operated from a remote location. An electronic trip unit 18 is positioned within a trip unit recess 18A also formed within the circuit breaker cover. In accordance with the invention, a combined auxiliary switch-contacts condition indicator hereafter "switch-indicator unit" 22 is positioned within the associated recess 22A in the circuit breaker cover and interacts with the circuit breaker crossbar (not shown) by means of the auxiliary switch lever 32 in the manner described within the aforementioned U.S. Pat. No. 4,912,439. Remote indication of the condition of the circuit breaker contacts (not shown) is made by means of the wire conductors 33 extending from the bottom of the switch indicator unit case 23. A shutter 25 is pivotally positioned on the underlying surface 31 of the switch indicator unit before attaching the associated cover 24. A visual access hole 26 is arranged through the cover for viewing the position of the shutter 25 and the underlying surface 31 in the manner to be described below in greater detail. When the actuator-accessory unit 19 and switch indicator unit 22 are positioned within their associated recesses, the accessory cover 13 is fastened to the circuit breaker cover 12 by means of screws 28, thru-holes 29 and threaded openings 30.

Figure 3:
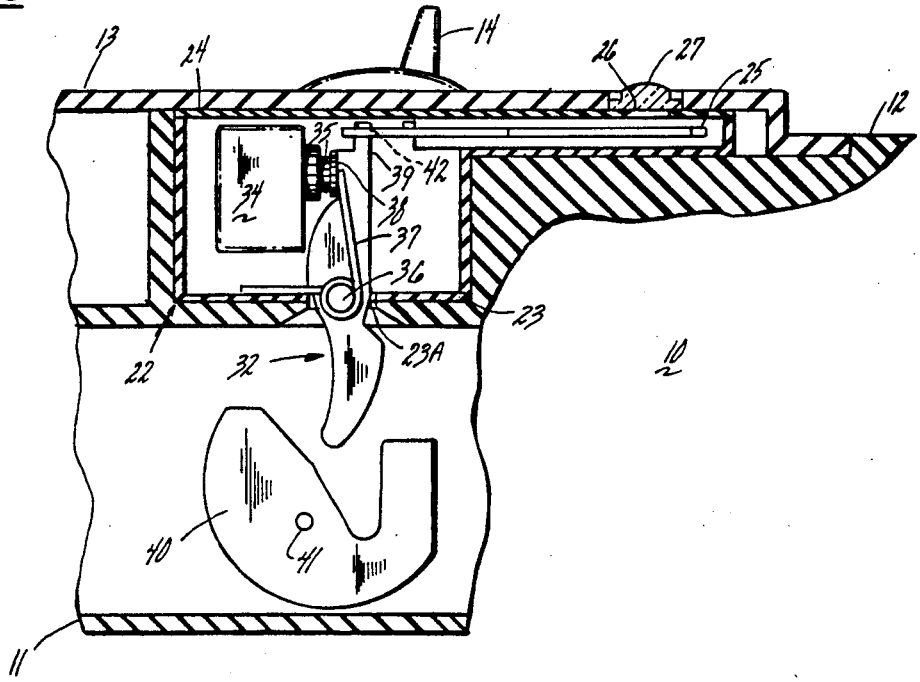
FIG. 3 is a side view in partial section of the circuit breaker depicted in FIG. 1 prior to actuating the auxiliary switch-contacts condition indicating unit contained therein.

The switch indicator unit 22 as shown within the cover 12 of the circuit breaker 10 of FIG. 3 includes a microswitch 34 that is actuated by the switch button 35 that interacts with the auxiliary switch lever 32 by means of the auxiliary switch tab 38 as described in the aforementioned U.S. Pat. No. 4,831,221. The auxiliary switch lever extends through a slot 23A in the switch-indicator unit case 23 and is pivotally attached within the case by means of a pivot pin 36 and is biased into contact with the switch button 35 by means of the torsion spring 37. With the operating handle 14 in the "ON" position as indicated, the operating mechanism crossbar 40 which is positioned within the circuit breaker case 11 by means of the pivot post 41 is out of contact with the auxiliary switch lever 32 such that the microswitch 34 remains inactuated. The upward extension 39 on the auxiliary switch lever projects within a slot 42 formed within one end of the shutter 25 to thereby cause the shutter to move in response to the position of the auxiliary switch lever 32. A window 27 is formed within the accessory cover 13 superjacent an aperture 26 formed through the cover 24 of the switch indicator unit case 23 for viewing the paddle exterior to the circuit breaker. In lieu of providing an aperture in the switch-indicator unit cover, the cover can be made of a transparent plastic material such as Lexan, which is a trademark of GE Company for polycarbonate resin.

Figure 4:
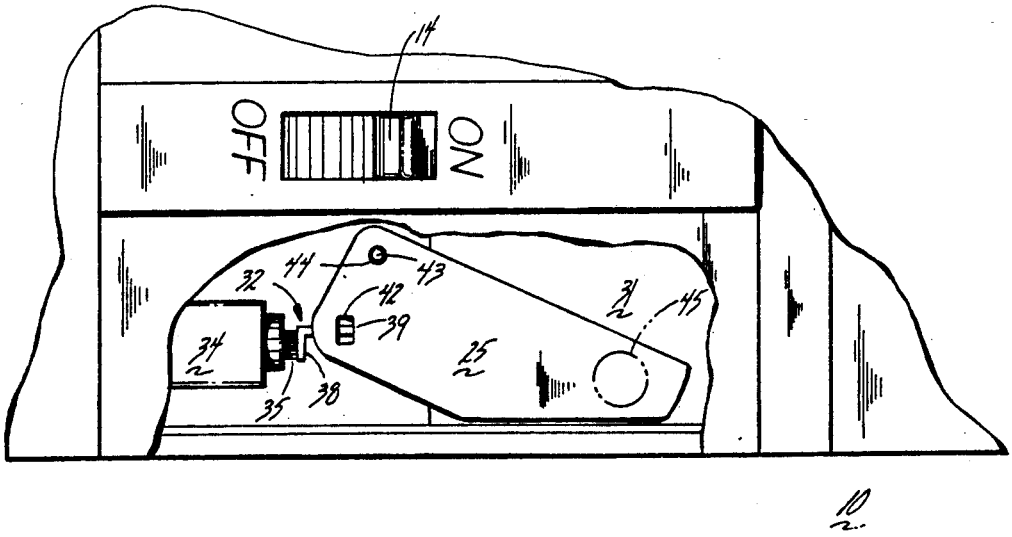
FIG. 4 is a top view in partial section of the circuit breaker of FIG. 3.

Referring now to the top of the circuit breaker 10 shown in FIG. 4, it can be seen that the shutter 25 includes ON indicia 45 which can comprise a red colored circle that is viewable through the window 27 and aperture 26 of FIG. 3. The underlying surface 31 can be colored green and is as also viewed through the window and the aperture when the circuit breaker contacts are in their OPEN condition. In the ON position of the circuit breaker handle 14 depicted in FIGS. 3 and 4, the auxiliary switch tab 38 on the auxiliary switch lever 32 contacts the switch button 35 such that the microswitch 34 remains inactuated and the shutter 25 is in the inactuated position determined by the extension 39 of the auxiliary switch lever 32 which extends through the slot 42 in the shutter and which has rotated the shutter about the pivot pin 43 extending through the pivot pin slot 44. With the circuit breaker operating handle 14 in the ON position, the red colored circle 45 is viewed through the window and aperture and the green colored underlying surface 31 is not visible. It is noted that the operating mechanism crossbar unit 40 can only rotate when the contacts are free to OPEN and CLOSE since the crossbar unit moves with the movable contact arm as described within U.S. Pat. No. 4,782,583. If the contacts are welded together, the crossbar unit would remain in the position shown in FIG. 5 even if the operating handle 14 was translated to its OFF position.

Figure 5:
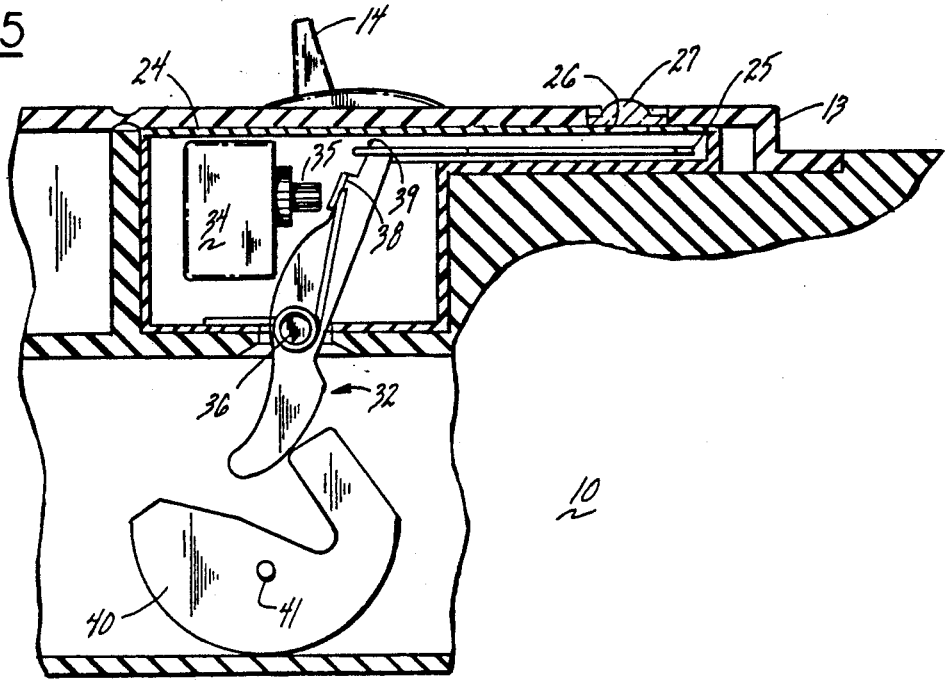
FIG. 5 is a side view in partial section of the circuit breaker of FIG. 1 with the auxiliary switch-contacts condition indicator unit in the actuated condition.
Figure 6:
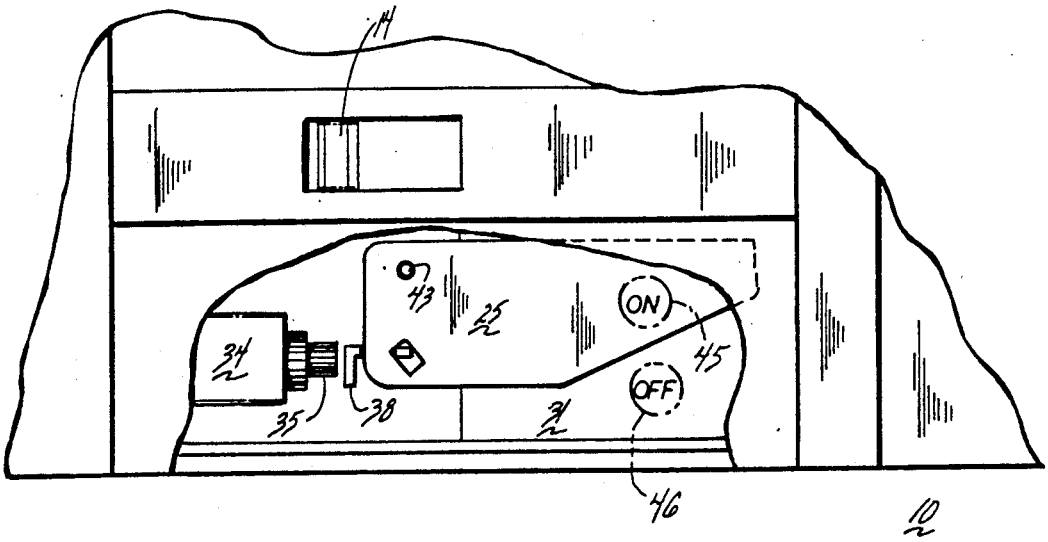
FIG. 6 is a top view in partial section of the circuit breaker of FIG. 5.

When the circuit breaker operating handle 14 within the circuit breaker 10 depicted in FIGS. 5 and 6 is moved to the OFF position and the operating mechanism crossbar unit 40 has rotated in the counterclockwise direction about the pivot post 41 driving the end of the crossbar into contact with the auxiliary switch lever 32 and rotating the auxiliary switch lever clockwise about the pivot pin 36, the auxiliary switch tab 38 is moved away from the switch button 35 to actuate the microswitch 34 and provide indication to a remote observer that the circuit breaker contacts are in the OPEN condition. The extension 39 on the auxiliary switch lever 32 rotates the shutter 25 away from the window 27 in the accessory cover 13 and the aperture 26 in the auxiliary switch-contact indicator cover 24. As shown in the circuit breaker 10 depicted in FIG. 6, the shutter 25 carrying the red indicia 45 has rotated counterclockwise about pivot pin 43 such that the underlying surface 31 is now exposed such that the green colored indicia 46 is now visible through the window 27 and aperture 26 of FIG. 5 to indicate that the contacts are in their OFF condition. The auxiliary switch tab 38 remains away from the switch button 35 on the microswitch 34 until the operating handle 14 is translated back to the ON position shown in FIGS. 3 and 4 rotating the crossbar unit and causing the shutter 25 to rotate clockwise about the pivot pin 43. The green colored indicia 46 is then blocked by the shutter and the red colored indicia 45 on the shutter is back under the window and aperture 27, 26 as shown earlier in FIGS. 3 and 4.

Having thus described my invention, what I claim as new and desire to secure by Letters Patent is:

1. An auxiliary switch-contacts condition indicator accessory comprising:

an enclosure comprising a case and a cover;

a switch unit arranged within said enclosure and operated by means of a switch button;

an actuator lever pivotally-mounted within said enclosure and arranged for contacting said switch button when said switch unit is inactuated and releasing said switch button when said switch is actuated;

a paddle within said enclosure and connecting with said lever for movement to first and second positions in response to movement of said actuator lever, said cover being adapted for providing visual access to said paddle when moved to either said first or said second position; and an extension on said lever and a slot within said paddle, said extension being retained within said slot to move said paddle in unison with said lever.

2. The accessory of claim 1 including a pivot pin extending through said paddle allowing said paddle to pivot between said first and second positions.

3. The accessory of claim 1 wherein a bottom part of said actuator lever extends below said cover interacting with a circuit breaker operating mechanism.

4. The accessory of claim 1 wherein said paddle includes indicia of said first or second position.

5. The accessory of claim 1 wherein said case includes indicia of said first or second position.

* * * * *